US005700618A

United States Patent [19]

Faust et al.

[11] Patent Number: 5,700,618

[45] Date of Patent: Dec. 23, 1997

[54] PROCESS FOR THE PRODUCTION OF COLORED IMAGES BY AN ELECTROPHOTOGRAPHIC ROUTE

[75] Inventors: Raimund Josef Faust, Wiesbaden; Silvia Lutz, Mainz, both of Germany

[73] Assignee: Agfa-Gevaert AG, Leverkusen, Germany

[21] Appl. No.: 579,434

[22] Filed: Dec. 27, 1995

[30] Foreign Application Priority Data

Dec. 29, 1994 [DE] Germany ..... P 44 47 104.1

[51] Int. Cl.[6] ..... G03G 13/16

[52] U.S. Cl. ..... 430/124; 430/186

[58] Field of Search ..... 430/114, 115, 430/110, 124, 126

[56] References Cited

U.S. PATENT DOCUMENTS

| | | | |
|---|---|---|---|
| 4,040,828 | 8/1977 | Evans | 96/1.2 |
| 4,388,391 | 6/1983 | Schell | 430/49 |
| 4,913,992 | 4/1990 | Steele et al. | 430/45 |
| 4,925,766 | 5/1990 | Elmasry et al. | 430/115 |
| 5,114,822 | 5/1992 | Kato et al. | 430/114 |

FOREIGN PATENT DOCUMENTS

| | | |
|---|---|---|
| 0 325 150 | 7/1989 | European Pat. Off. . |
| 0 372 764 | 6/1990 | European Pat. Off. . |
| 0 034 317 | 8/1991 | European Pat. Off. . |
| 39 37 203 | 5/1991 | Germany . |

OTHER PUBLICATIONS

Patent Abstracts of Japan, vol. 14, No. 49, JP 01-278386, Nov. 8, 1989.

Patent Abstracts of Japan, vol. 17, No. 302, JP 05-27116, Feb.5, 1993.

*Primary Examiner*—John Goodrow
*Attorney, Agent, or Firm*—Foley & Lardner

[57] ABSTRACT

A process for the production of a colored image by an electrophotographic route by electrostatic charging, image-wise exposure to light and toning of a photoconductor material with a colorless transparent toner which includes a colorless polymeric binder and a colorless polymeric charge control agent, and transfer of the toner image to a colored layer which is soluble in a solvent and is on a layer carrier, fixing of the toner image and removal of the areas of the colored layer not covered by the toner image by washing out with a solvent. The process utilizes the high photosensitivity of electrophotographic materials, without the possibility of color falsification due to colored toners. The procedure is simpler compared with known electrophotographic processes, since the same toner can be employed in all steps and does not have to be washed off.

18 Claims, No Drawings

PROCESS FOR THE PRODUCTION OF COLORED IMAGES BY AN ELECTROPHOTOGRAPHIC ROUTE

BACKGROUND OF THE INVENTION

1. Field of the Invention

The invention relates to a process for the production of colored images, in particular color proofs, in which a toner image is produced by electrostatic charging, imagewise exposure to light and toner treatment of a photoconductor material. This toner image is transferred to a layer which is soluble in a solvent and is on a layer carrier. The toner image is fixed there, and the areas of the layer not covered by the toner image are removed from the layer by washing out with a solvent.

2. Description of Related Art

Color proofing films are usually produced and processed by exposure to light and development of photosensitive colored materials. These processes have the disadvantage that the photosensitive materials employed in them are of too low a sensitivity to be exposed to light directly with computer data, for example, by means of a laser scanner.

The ink jet process is a very rapidly operating and inexpensive process for image production. However, it is not suitable for high-resolution in-register reproduction of color separations for planographic printing.

The electrophotographic process is a known image production process with good image resolution and high sensitivity. It can be employed for digital image production, such as is described, for example, in U.S. Pat. No. 4,913,992 and No. 4,925,766. However, this process is complicated, expensive, and susceptible to trouble. EP-A 372 764 describes a similar process which uses colored liquid toners.

In all known color proofing methods which use electrophotographic means, colored toners ere employed for production of the primary color images. These methods have the disadvantage that it is difficult to always achieve a constant color density of the image areas. A separate toning unit is of course also necessary for each color. Since sensitized photoconductor layers are often employed for image production, the finished image is also falsified by the intrinsic coloration of the layers.

SUMMARY OF THE INVENTION

An object of the invention was to propose a color proofing method which uses materials of high photosensitivity and is therefore suitable for digital image production, which is technologically easy to carry out and which produces the colored images which have the desired color shade without falsification.

In accordance with these objectives, there is provided a process for the production of a colored image by an electrophotographic route comprising; electrostatic charging, imagewise exposure to light, and toner treatment of a photoconductor material to give a toner image; transfer of the toner image onto a colored layer that, is soluble in a solvent and that is on a carrier layer; fixing of the toner image onto the colored layer; and removal from the colored layer of the areas not covered by the toner image by washing out with a solvent; wherein the toner includes a colorless transparent toner which includes a colorless polymeric binder and a colorless polymeric charge control agent.

Further objects, features, and advantages of the invention will become apparent from the detailed description of preferred embodiments that follows.

DETAILED DESCRIPTION OF PREFERRED EMBODIMENTS

The invention relates to a process for the production of a colored image by an electrophotographic route by electrostatic charging, imagewise exposure to light and toner treatment of a photoconductor material and transfer of the toner image onto a colored layer which is soluble in a solvent and is on a layer carrier, fixing of the toner image, and removal from the colored layer of the areas not covered by the toner image by washing out with a solvent.

The process according to the invention uses a colorless transparent toner which includes a colorless polymeric binder and a colorless polymeric charge control agent.

Any desired colorless, transparent polymeric binders and control agents are useful in the present invention. The toners may be positively or negatively chargeable. If the process according to the invention uses positively chargeable colorless liquid toners, these preferably comprise, as the binder, a graft copolymer of recurring units A, B, C, and D.

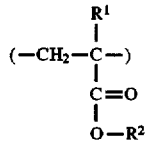
(A)

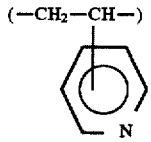
(B)

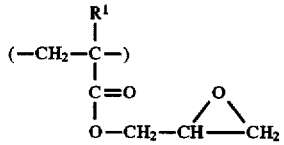
(C)

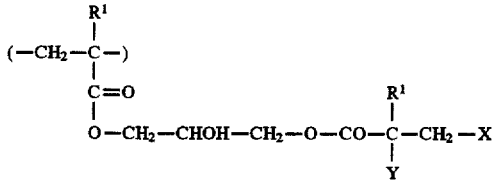
(D)

in which X and Y are initiator radicals or grafted-on polymeric radicals of units B, E, and F

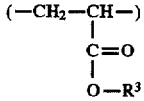
(E)

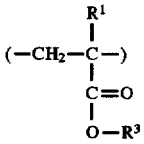
(F)

in which $R^1$ is a hydrogen atom or a methyl group, $R^2$ is an alkyl group having 6 to 18 carbon atoms, $R^3$ is an alkyl group having 1 to 3 carbon atoms and not more than one of the radicals X and Y is an initiator radical. The values of the R radicals can vary in the recurring units described above and hereinafter.

Upon initiation of the graft polymerization, a radical of the thermally activatable polymerization initiator is linked to one of the double bond carbon atoms of the (meth)acryloyl radical of the unit from which D is formed by graft polymerization. On such addition to the double bond, the other carbon atom is converted to a free radical capable of starting the polymerization of unsaturated compounds to form a chain of units B and E. The polymerization initiator may be e.g. a peroxy or azo compound.

The positively chargeable colorless toners comprise any desired charge control substance and preferably comprise, as the charge control substance, a polymer with units A and G, in which A has the abovementioned meaning and G corresponds to the formula

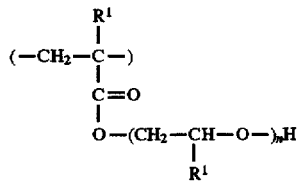

(G)

in which $R^1$ has the abovementioned meaning, the two $R^1$ can be identical or different, and n is a number from 1 to 3.

If the process uses negatively chargeable colorless toners, these preferably comprise, as the binder, a graft copolymer of recurring units A, B', C and D', in which B' corresponds to the formula

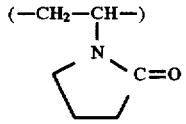

(B')

D' is a unit of the formula given above for D, in which the grafted-on radicals consist of units B' and F, and the symbols A, C, and F have the abovementioned meaning.

The negatively chargeable colorless toners can include any desired charge control substance. Preferably the charge control substance comprises a polymer with units, H, I and K, in which H corresponds to the formula

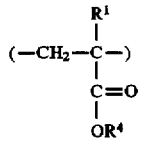

I corresponds to the formula

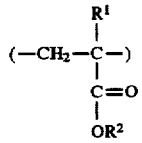

and

K corresponds to the formula

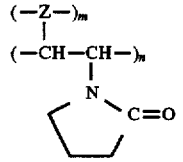

in which $R^1$ and $R^2$ have the abovementioned meaning, the two $R^1$ can be identical or different, $R^4$ is an alkyl group having 1 to 6 carbon atoms and Z is a radical formed by removal of a hydrogen atom from a unit H or I.

The positively chargeable liquid toners described above and their preparation are described in detail in patent application P 44 47 107.6—U.S. Attorney Docket No. 16878/665 filed at the same time, now U.S. Ser. No. 08/679,433. The corresponding negatively chargeable liquid toners are described in the patent application P 44 47 106.8—U.S. Attorney Docket No. 16878/667 filed at the same time, now U.S. Ser. No. 08/578,982. The German Applications and their corresponding U.S. Applications are incorporated herein in their entireties by reference.

In contrast to customary electrophotographic toners, the liquid toners employed according to the invention are colorless and transparent, and they also comprise no active constituents suitable for subsequent processing as color-forming agents.

The binders preferably contained in the positively chargeable liquid toners comprise a number of different units. Their basic chain contains units A of alkyl (meth)acrylates having 6 to 18 carbon atoms in the alkyl group. These units promote the formation of stable dispersions. The basic chain furthermore contains units B which are derived from vinylpyridine, in particular 4-vinylpyridine, and promote the positive chargeability. It furthermore contains units C of (meth) acrylic acid esters of functional groups, via which linking with the grafted-on side chains takes place. These units are preferably glycidyl (meth)acrylate units. These units are usually also still present in the finished graft polymer, since during the reaction with reactive compounds, in particular (meth)acrylic acid, onto which the grafted-on side chains later add, they are not completely reacted. Finally, the basic chain also contains those units which are formed from the glycidyl methacrylate units by reaction with functional compounds, in particular unsaturated carboxylic acids, and further polymerization thereof with unsaturated compounds to give polymeric side chains. The side chains in turn contain units of type B and units F of short-chain alkyl (meth) acrylates, at least some of the alkyl (meth)acrylate units being alkyl acrylate units E.

The amounts of units A, B, C and D in the basic chain can be varied to give desired polymers, and are in general in the range of 50–100, preferably 60–80 parts by weight of A, 0.5–3.0, preferably 1–2 parts by weight of B, 0.5–4, preferably 1.5–3 parts by weight of C and 250–1000, preferably 350–600 parts by weight of D.

These graft copolymers are mixed With any desired charge control substances or control agents. These agents are preferably copolymers of units A and G. The ratio of the amounts of units A and G is preferably in the range from 67 to 98, in particular 80 to 94% by weight of A to 2 to 33, in particular. 6 to 20% by weight of G.

The graft copolymers used in the present invention may be prepared in any desired manner and are expediently prepared in several stages. For example, a polymer is first prepared by solution or emulsion polymerization of monomers which form units A, B, and C to form a terpolymer. This terpolymer is reacted with acrylic or methacrylic acid in the presence of a tertiary amine in a second stage, the glycidyl group of unit C reacting with the carboxyl group of the (meth)acrylic acid to form an ester. The amounts in this stage are chosen such that the carboxyl groups are reacted completely and only some of the epoxide groups are esterified. In general, about 0.1 to 0.9, preferably 0.2 to 0.75 equivalent of acid is employed per equivalent of epoxide groups.

Then, further monomers of types B, E, and F are polymerized in the presence of the polymer with lateral (meth) acryloyloxy groups in a grafting polymerization reaction. The ratio of the amounts of units B, E, and F in the side chain is in general chosen such that on average about 1–20 units B, 150–300 units E, and 70–150 units F are present per unit of (meth)acrylic acid.

Any desired process may be used to prepare the positively chargeable liquid toner. Generally, the finished graft copolymers are mixed with polymeric charge control substances of the abovementioned composition. The charge control agent is likewise prepared from the monomers which form units A and G by conventional polymerization, such as emulsion or solution polymerization.

In the polymer's unit A, $R^2$ is an alkyl radical having 6 to 18, preferably 8 to 15 carbon atoms; $R^3$ is preferably a methyl group. In units G, $R^1$ is preferably a hydrogen atom and n=1. The polymer in general contains units A in an amount of 67–98, preferably 80–94% by weight, and units G in an amount of 2–33, preferably 6–20% by weight.

The amounts of binder and control substance may be varied as desired and are in general in the range of 80–99, preferably 85–96% by weight of binder and 1–20, preferably 4–15% by weight of control agent.

The graft copolymers preferably employed as binders in the negatively chargeable liquid toners contain units A of the structure described above. Their basic chain furthermore contains units B', which are derived from N-vinyl-2-pyrrolidone and promote negative chargeability. They furthermore contain units C of the composition described above. Finally, the basic chain also contains units D', which are formed from the glycidyl methacrylate units by reaction with functional compounds, in particular unsaturated carboxylic acids, and further polymerization thereof with unsaturated compounds to give polymeric side chains. The side chains in turn contain units of type B' and units F of short-chain alkyl (meth)acrylates, at least some of the alkyl (meth)acrylate units comprising of alkyl acrylate units. The amounts of units A, B', C, and D' in the basic chain are in the same ranges as stated above for A, B, C, and D.

The negatively chargeable charge control substances or control agents may include any desired substances and are preferably graft copolymers of units H, I, and K. The amounts of units H, I, and K are preferably in the range from 60 to 98, in particular 70 to 90% by weight of H, 0 to 30, in particular 5 to 20% by weight of I and 1 to 20, in particular 2 to 10% by weight of K.

The graft copolymers of A, B', C, and D' are prepared in principle in the same manner as the graft copolymers of A, B, C, and D described above.

The graft copolymers which are used as negatively chargeable charge control substances are prepared in an analogous manner, but the stage of addition of (meth)acrylic acid onto an epoxide group is omitted.

The amounts of binder and charge control substance in the negatively chargeable liquid toners are generally in the same ranges as discussed above for the positively chargeable liquid toners.

The toner may also be a colorless dry toner of desired makeup, since dry toner does not require a charge control agent. The colorless dry toners preferably employed in the process according to the invention may comprise, as binders, copolymers of units of styrene (I), ethyl acrylate (II) and dialkylaminoethyl (meth)acrylates (III). The alkyl groups in (II) are preferably methyl or ethyl groups here. The amounts of units I, II, and III are generally 65–80% by weight for I, 18–30% by weight for II, and 0.1–5% by weight for III.

The ethyl acrylate units are of particular importance for the properties of the copolymers and of the toners prepared therefrom, in particular their resistance to chemicals. The units (III) effect the positive chargeability of the toners, without impairing their transparency and colorlessness in the visible spectral range.

The copolymers can additionally contain units of methyl methacrylate which promote the formation of easily fixable, tack-free films during thermal fixing. If components of this type are added, the content is preferably not more than 10, preferably 3–6% by weight of the copolymers.

The copolymers can be prepared in a manner known per se by polymerization in organic solvents using initiators which form free radicals, such as peroxides or azo compounds.

Any desired color layer(s) which can be removed by washing out with suitable solvents, in particular aqueous alkaline solutions can be used. They generally comprise a colorless polymeric binder which is soluble in a solvent and a dyestuff or a colored pigment and if appropriate plasticizers, surfactants, or other customary additives. Adhesive layers which can be activated by heat can be applied to the color layers, facilitating transfer of these layers by lamination. Materials of this type are known and are described, for example, in EP-A 197 396, 294 665, 286 919, and 325 150. Each of these documents is hereby incorporated by reference in its entirety.

In the known materials, the color layers in general also comprise photosensitive substances, for example, photopolymerizable mixtures. These are not necessary in the color layers employed according to the invention. However, the same binders, dyestuffs, or colored pigments and other additives such as are described in the prior art can be employed for the process according to the invention.

The process comprises producing a toner image corresponding to a color separation by an electrophotographic route in a manner known per se, transferring this to the associated colored layer and fixing it there. The areas of the colored layer which are not covered are then removed by washing out with a suitable solvent, preferably an aqueous alkaline solution. In the same manner, further separation images can be produced on separate layer carriers of transparent films of plastic and can be laid one on top of the other to give a multicolored image. This method of color proofing is called the overlay process.

Preferably, however, the multicolored image is produced by the surprinting process in which the image layers of the individual primary-color images are combined on a common layer carrier, preferably a white-pigmented film, and produce the multicolored image there. For this, after the first primary-color image has been developed, the next color layer is transferred to the first primary-color image by lamination, and the corresponding toner image is transferred to this layer in register and processed further to give the second primary-color image as in the first case. The complete multicolored image, in general a four-color image comprising the colors cyan, magenta, yellow and black, is produced successively on a single layer carrier in this manner. This type of colored image production is known per se and is described, for example, in the documents mentioned above.

In the process according to the invention, only the portions of the colored layer which are covered by the colorless, transparent toner image remain as image elements in each separation image. A color which is not falsified by an intrinsic coloration of other constituents of the layer, for example, photosensitive substances, or by any remaining residual staining from colored toner images can be produced in this manner.

Preferred embodiments of the process according to the invention are described in the following examples. The examples are for illustrative purposes only and do not limit the scope of the invention. Ratios of amounts and percentages are to be understood in these examples as weight units, unless stated otherwise.

EXAMPLE 1

Four biaxially stretched and heat-set transparent polyethylene terephthalate films 75 μm thick were coated with the following solutions (amounts in parts by weight):

| | Cyan | Magenta | Yellow | Black |
|---|---|---|---|---|
| Maleic acid partial ester/styrene copolymer ($M_n$ = 50000; acid number 185) | 3.33 | 3.80 | 4.60 | 3.71 |
| Maleic acid partial ester/styrene copolymer ($M_n$ =45000; acid number 175) | 1.17 | — | — | — |
| p-Toluenesulfonic acid | — | 0.18 | — | 0.35 |
| Dimethyl phthalate | 0.75 | 0.88 | 0.75 | 0.75 |
| Dibutyl phthalate | 0.25 | — | 0.25 | 0.25 |
| 2-Methoxy-ethanol | 41.00 | 46.50 | 41.00 | 41.00 |
| Butanone | 41.00 | 46.48 | 41.00 | 41.00 |
| Butyrolactone | 10.00 | — | 10.00 | 10.00 |
| Phthalocyanine blue | 1.17 | — | — | — |
| Purple pigment | — | 1.44 | — | — |
| Yellow pigment | — | — | 1.04 | — |
| Carbon black | — | — | — | 0.94 |

The solutions were dried and the resulting color films had the following layer thicknesses and optical densities:

| | | | | |
|---|---|---|---|---|
| Layer weight, g/m$^2$ | 2 | 2 | 2 | 2 |
| Optical density | 1.1 | 1.2 | 0.9 | 1.5 |

An adhesive layer 15 μm thick which could be activated by heat, of 95% by weight of polyvinyl acetate having a Brookfield viscosity RVT of 1000–4000 mPa.s, measured in accordance with ISO/DIN 2555 at 20 revolutions per minute with spindle 3, and 5% by weight of carboxymethylcellulose was applied to each of the color layers.

To produce a multicolored proof, the procedure was as follows:

The cyan film was laminated onto a white-pigmented polyester film at elevated temperature in a commercially available laminator and the transparent carrier film was peeled off from the colored layer. A positively charged charge image was then produced on the photoconductor tape from a positive color separation film for the color cyan in a commercially available electrophotographic copying apparatus operating with liquid toner, and was toned with the negatively chargeable, colorless and transparent electrophotographic liquid toner described below, and the resulting toner image was transferred to the cyan colored layer of the white polyester film and fixed by heating at 110° C. For removal of the layer, the film was sprayed with a solution of 3.0% of sodium decyl sulfate, 1.5% of disodium phosphate and 0.5% of sodium metasilicate, the regions of the color layer not covered by the toner image being dissolved. A cyan image on the white film was obtained.

The magenta layer of the corresponding color film was transferred onto the film with the cyan image in the same laminator and the carrier film was peeled off. A magenta image was then produced on the cyan image in the same manner as for the cyan image by exposure to light under the corresponding magenta color separation, toner treatment, toner image transfer to the magenta layer in the register, fixing and layer removal. The yellow and black image were then produced on the same carrier in the same manner. The resulting four-color image was of high quality and suitable for testing the color separations as copying masters for four-color printing.

The negatively rechargeable toner employed above was prepared as follows:

Synthesis of a graft polymer as the binder

Reaction stage 1

72 g of 2-ethylhexyl methacrylate, 1.2 g of N-vinyl-2-pyrrolidone, 2.7 g of glycidyl methacrylate, 1.0 g of azoisobutyronitrile and 125 g of Isopar H (mixture of branched $C_{10}$ to $C_{12}$ paraffin hydrocarbons, boiling range 179°–192° C.; flash point 58° C.) were initially introduced into a three-necked flask with a reflux condenser, gas inlet tube and stirrer and were polymerized under extra pure nitrogen; for this, the mixture was heated to 90° C. with a heating bath and polymerization was carried out at 90° C. for 6 hours, while stirring. After cooling, the mixture was aerated, 100 ml of Isopar H were added and some (100 ml) of the solvent was then distilled off in vacuo under 20 mbar in order to remove residual monomers. The polymer solution thus obtained was colorless and transparent in appearance and slightly viscous.

Reaction stage 2

The intermediate product obtained from reaction stage 1 was reacted with methacrylic acid in a three-necked flask with a reflux condenser, gas inlet tube and stirrer. For this, 200 g of the intermediate product were initially introduced into the flask and heated to 90° C., and 0.16 g of dimethylaminododecane and, after 30 minutes, 0.42 g of methacrylic acid were added. After a total reaction time of 14 hours at 90° C., a colorless, transparent reaction product was obtained.

Viscosity: 89 to 105 mPa.s

Solids: 40% by weight

Reaction stage 3

29.0 g of the product from reaction stage 2, 54 g of methyl acrylate, 27 g of methyl methacrylate, 5.0 g of N-vinyl-2-pyrrolidone, 0.4 g of tert-dodecylmercaptan and 0.9 g of azoisobutyronitrile were initially introduced into a three-necked flask with a reflux condenser, gas inlet tube and stirrer under extrapure nitrogen and were heated to an internal temperature of 90° C. Polymerization was carried out at 90° C. for 7 hours; a further 0.8 g of azoisobutyronitrile was then added and polymerization was carried out again at 90° C. for 5 hours. After cooling, the mixture was aerated, 100 ml of Isopar H were added and some of the solvent (100 ml) was removed by distillation in vacuo in order to remove residual monomers. A milky-white reaction product was obtained. (Solution A)

Viscosity: 3.2 to 3.6 mPa.s at 30% by weight of solids

Conductivity: 7 to $10\times10^{-12}$ siemens/cm

Synthesis of a polymeric control agent 85 g of lauryl methacrylate, 15 g of methyl methacrylate and 0.5 g of azoisobutyronitrile in 300 g of Isopar H were polymerized in a three-necked flask with a reflux condenser, dropping funnel with a pressure compensation and gas inlet tube and stirrer at 80° C. under extra pure nitrogen. After 4 hours, a further 0.5 g of azoisobutyronitrile was added and the entire mixture was polymerized at 80° C. for a further 4 hours. 6.0 g of N-vinyl-2-pyrrolidone were now added to this copolymer solution and polymerization was carried out again at 100° C. under extra pure nitrogen. After 8 hours, a graft polymer of polymer type B was obtained. 100 ml of Isopar H were added to this polymer and 50 ml of the solvent were distilled off under 20 mbar; contents of residual monomers were removed in this manner. Thereafter, after a gravimetric determination of the solids, Isopar H was added in an amount such that a solids content in the graft polymer of 18.5% by weight was obtained. (Solution B)

Preparation of a colorless liquid toner

Preparation of the liquid concentrate

The toner concentrate was prepared by mixing 66.9 g of solution A, 7.03 g of solution B and 235 g of Isopar G For this, solution A and solution B were first stirred at 60° C. for 1 hour and, after cooling, Isopar G was added and the mixture was stirred again for 5 minutes.

Preparation of the toner by dilution 4 parts by volume of Isopar G were added to 1 part by volume of liquid concentrate and the mixture was stirred at room temperature for 5 minutes.

EXAMPLE 2

The procedure was as in Example 1, but a negative charge image was produced in the electrophotographic copying apparatus and was developed with a positively chargeable, colorless and transparent toner. The toner was prepared as follows:

Synthesis of a graft polymer as the binder

Reaction stage 1

72 g of 2-ethylhexyl methacrylate, 1.2 g of 4-vinylpyridine, 2.7 g of glycidyl methacrylate, 1.0 g of azoisobutyronitrile and 125 g of Isopar H (mixture of branched $C_{10}$ to $C_{12}$ paraffin hydrocarbons, boiling range 179°–192° C.; flash point 58° C.) were initially introduced into a three-necked flask with a reflux condenser, gas inlet tube and stirrer and were polymerized under extra pure nitrogen; for this, the mixture was heated to 90° C. with a heating bath and polymerization was carried out at 90° C. for 6 hours, while stirring. After cooling, the mixture was aerated, 100 ml of Isopar H were added and some (100 ml) of the solvent was then distilled off in vacuo under 20 mbar in order to remove residual monomers. The polymer solution thus obtained was colorless and transparent in appearance and slightly viscous.

Reaction stage 2

The intermediate product obtained from reaction stage 1 was reacted with methacrylic acid in a three-necked flask with a reflux condenser, gas inlet tube and stirrer. For this, 200 g of the intermediate product were initially introduced into the flask and heated to 90° C., and 0.16 g of dimethylaminododecane and, after 30 minutes, 0.42 g of methacrylic acid were added. After a total reaction time of 14 hours at 90° C., a colorless, transparent reaction product was obtained.

Viscosity: 89 to 105 mPa.s

Solids: 40% by weight

Reaction stage 3

29.0 g of the product from reaction stage 2, 54 g of methyl acrylate, 27 g of methyl methacrylate, 3.0 g of 4-vinylpyridine, 0.4 g of tert-dodecylmercaptan and 0.9 g of azoisobutyronitrile were initially introduced into a three-necked flask with a reflux condenser, gas inlet tube and stirrer under extra pure nitrogen and were heated to an internal temperature of 90° C. Polymerization was carried out at 90° C. for 7 hours; a further 0.8 g of azoisobutyronitrile was then added and polymerization was carried out again at 90° C. for 5 hours. After cooling, the mixture was aerated, 100 ml of Isopar H were added and some of the solvent (100 ml) was removed by distillation in vacuo in order to remove residual monomers. A milky-white reaction product was obtained. (Solution A)

Viscosity: 3.2 to 3.6 mPa.s at 30% by weight of solids

Conductivity: 7 to $10\times10^{-12}$ siemens/cm

Synthesis of a polymeric control agent 35 g of lauryl methacrylate, 4.5 g of 2-hydroxyethyl methacrylate, 0.09 g of tert-dodecylmercaptan and 0.11 g of azoisobutyronitrile, dissolved in 120 g of toluene, were initially introduced into a three-necked flask with a reflux condenser, dropping funnel with a gas inlet tube and stirrer under extra pure nitrogen and were first heated to 70° C. After 1 hour, the mixture was heated to 80° C., and after another 2 hours, the temperature was increased to 90° C.

107 g of lauryl methacrylate, 13.7 g of 2-hydroxyethyl methacrylate, 0.26 g of tert-dodecylmercaptan and 0.33 g of azoisobutyronitrile, dissolved in 120 g of toluene, were now added in the course of 2 hours and, when addition had ended, polymerization was carried out at 90° C. for a further 4 hours. The mixture was then cooled and aerated. The toluene was distilled off in vacuo under 20 mbar. 240 ml of Isopar G [paraffin hydrocarbon mixture (boiling range 158°–176° C.; flash point 41° C.)] were then added. Solids content: 40% by weight (solution B)

Preparation of a colorless liquid toner

Preparation of the liquid concentrate

The toner concentrate was prepared by mixing 66.9 g of solution A, 3.25 g of solution B and 235 g of Isopar G For this, solution A and solution B were first stirred at 60° C. for 1 hour and, after cooling, Isopar G was added and the mixture was stirred for a further 5 minutes.

Preparation of the toner by dilution 4 parts by volume of Isopar G were added to 1 part by volume of liquid concentrate and the mixture was stirred at room temperature for 5 minutes.

Conductivity: $77.5\times10^{-12}$ siemens/cm

Deposition at the cathode (at 1000 V; 1 s): 270 mg/100 ml of liquid toner.

EXAMPLE 3

(Comparison example)

The procedure was as in Example 1, but instead of the colorless liquid toner, a black electrophotographic developer which is employed in normal production of copies was used. In this case, the black fixed toner image had to be washed off completely with a commercially available wash-out agent based on higher-boiling, chiefly aliphatic hydrocarbons after each layer removal step. Here also, a four-color image true to the original was obtained. However, this procedure was considerably more cumbersome because of the four washing out steps.

EXAMPLE 4

Preparation of a polymeric binder

A copolymer was prepared as described below. For this 69.9% by weight of styrene, 25.0% by weight of ethyl acrylate, 0.1% by weight of dimethylaminoethyl methacrylate, and 5.0% by weight of methyl methacrylate were mixed. 1527 g of butanone, 20% by weight of the monomer mixture described above and 1% by weight of azobisisobutyronitrile (AIBN), based on the total weight of the monomers, were initially introduced into a three-necked flask, which was provided with a stirrer, reflux condenser, dropping funnel with a pressure compensation tube and gas inlet tube, under a nitrogen atmosphere and were polymerized at the reflux temperature for 1 hour. The remainder of the monomer mixture was added with a dropping funnel in the course of one hour and the entire mixture was polymerized under reflux for a further four hours. A further 0.5% by weight of azobisisobutyronitrile was then added and polymerization was carried out for 4 hours. Working up was carried out by distilling off the solvent. The solid was isolated from the flask and dried at 100° C. in a drying cabinet for 12 hours.

Yield: about 90% by weight

Preparation of the toner

The resulting product was coarsely pre-ground in a cutting mill CS 15/10 Gr.01 from Condux Werke, Wolfgang by Hanau, FR Germany and finely ground in a ®Micro-Master Jet-Pulverizer, Class 04-503 from The Jet Pulverizer Co. Palmyra, N.J., USA. The binder was sifted to the desired particle size in a laboratory zigzag sifter unit A 100M 2 R from Alpine AG, Augsburg, FR Germany.

Testing of the toner properties: The particle size distribution was measured with a measuring instrument (Microvideomat from Zeiss, Oberkochen, FR Germany).

Particle size distribution: 2 to 15 μm

Average particle size: 4.1 μm

Resistance to chemicals:

very good resistance in aqueous alkaline developer media of pH 11 to 14 very good resistance in isopropanol only slightly swellable on cleaning with aliphatic hydrocarbons.

To measure the triboelectric chargeability, the toner powder was mixed with iron carrier type RZ from Mannesmann Demag, Mönchengladbach, FR Germany, diameter: 50 to 100 μm, which had been oxidized on the surface in a tempering process (2% by weight of toner powder, 98% by weight of iron carrier). The resulting developer mixture was charged electrostatically by means of a magnetic roller customary for electrophotographic copying apparatuses and was thus activated. The specific charge of the toner particles was then measured on an isolated electrode by a blowing out method.

Specific charge: +50 μC/g.

Toner images were produced from four color separations with the dry toner described above analogously to Example 1 in a commercially available electrophotographic copying apparatus operating with dry toner, and were transferred to the corresponding color films with transparent polyester films as the layer carrier and fixed there, and the areas of the layer not covered were removed with the solution described in Example 1. An overlay color proof was obtained by placing the four films with primary-color images one on top of the other.

In another experiment, the color layers which had been produced on white-pigmented films as layer carriers as described in Example 1 were processed on a common layer carrier, as described there, by lamination, toner image transfer, fixing and removal of the layers to give primary-color images which gave a four-color image of high quality.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention.

What is claimed is:

1. A process for the production of a colored image by an electrophotographic route, comprising electrostatic charging, imagewise exposing to light, and toner treating of a photoconductor material to give a toner image, transfer of the toner image onto a colored layer that is soluble in a solvent and that is on a carrier layer, fixing of the toner image onto the colored layer, and removal from the colored layer of the areas not covered by the toner image by washing out with a solvent, wherein the toner comprises a colorless transparent toner which includes a colorless polymeric binder and a colorless polymeric charge control agent.

2. A process as claimed in claim 1, wherein the colorless toner is a liquid toner, is positively chargeable, and comprises, as the colorless polymeric binder, a graft copolymer of recurring units A, B, C, and D

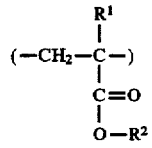

(A)

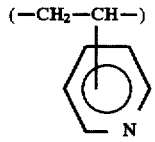

(B)

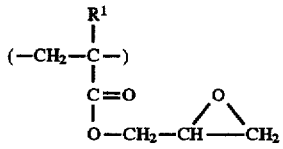

(C)

-continued (D)

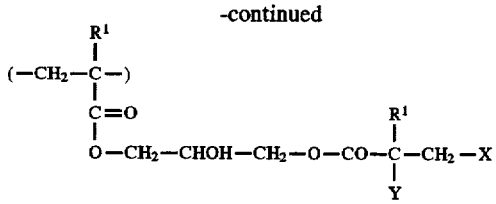

in which X and Y are initiator radicals or grafted-on polymeric radicals including units B, E, and F (E)

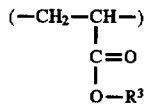

(F)

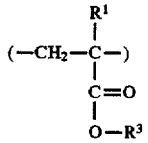

in which $R^1$ is a hydrogen atom or a methyl group, $R^2$ is an alkyl group having 6 to 18 carbon atoms, $R^3$ is an alkyl group having 1 to 3 carbon atoms, and not more than one of the radicals X and Y is an initiator radical.

3. A process as claimed in claim 2, wherein the control agent comprises a polymer with units A and G, wherein G corresponds to the formula (G)

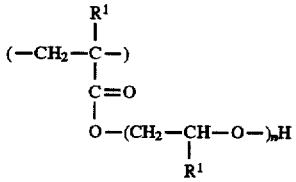

wherein the two $R^1$'s can be identical or different, and n is a number from 1 to 3.

4. A process as claimed in claim 1, wherein the colorless transparent toner is a liquid toner.

5. A process as claimed in claim 3, wherein the control agent comprises 67 to 98% by weight of A and 2 to 33% by weight of G, based on the weight of the control agent.

6. A process as claimed in claim 1, wherein the colorless toner is a liquid toner, is negatively chargeable and comprises, as the binder, a graft copolymer of recurring units A, B', C, and D'

(A)

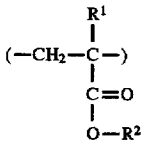

(B')

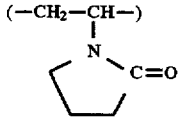

-continued (C)

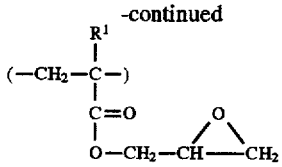

(D)

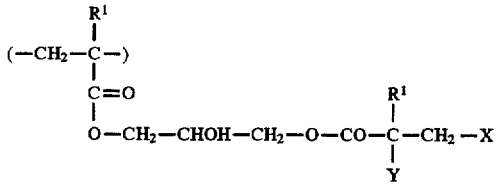

in which X and Y are initiator radicals or grafted on polymeric radicals including units B' and F, (F)

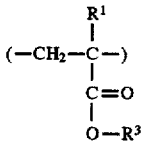

wherein $R^1$ is a hydrogen atom or a methyl group, $R^2$ is an alkyl group having 6 to 18 carbon atoms, and $R^3$ is an alkyl group having 1 to 3 carbon atoms, and not more than one of the radicals X and Y is an initiator radical.

7. A process as claimed in claim 6, wherein the control agent comprises a polymer with units H, I, and K, in which H corresponds to the formula

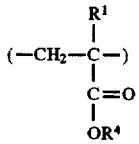

I corresponds to the formula

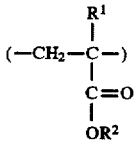

and

K corresponds to the formula

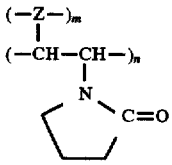

wherein $R^1$ is a hydrogen atom or a methyl group, $R^2$ is an alkyl group having 6 to 18 carbon atoms, $R_4$ is an alkyl group having 1 to 6 carbon atoms, and Z is a radical formed by removal of a hydrogen atom from a unit H or I.

8. A process for the production of a colored image by an electrophotographic route, comprising electrostatic charging, imagewise exposing to light, and toner treating of a photoconductor material to give a toner image, transfer of the toner image onto a colored layer that is soluble in a solvent and that is on a carrier layer, fixing of the toner image into the colored layer, and removal from the colored layer of the areas not covered by the toner image by washing out with a solvent, wherein the toner is a colorless transparent dry toner which includes a colorless polymeric binder.

9. A process as claimed in claim 1, wherein the color layer comprises a pigment or a dyestuff in a primary color of multicolor printing, the exposing to light is carried out under the color separation of a multicolor image associated with this primary color, a color layer which comprises a pigment or a dyestuff in another primary color is applied to the primary-color image corresponding to the color separation previously obtained and this layer is processed to a second primary-color image in the same manner by toner image transfer in the register, fixing and removal of the layer, and, optionally, these steps are repeated with at least one further primary color.

10. A process as claimed in claim 1, wherein in the removal step, the colored layer is washed out with an aqueous alkaline solution.

11. A process as claimed in claim 1, wherein the toner is positively chargeable.

12. A process as claimed in claim 1, wherein the toner is negatively chargeable.

13. A process as claimed in claim 8, wherein the toner includes as binder a copolymer of styrene (I) ethyl acrylate (II) and dialkylaminoethyl (meth)acrylate (III).

14. A process as claimed in claim 1, wherein the colored layer comprises a colorless polymeric binder which is soluble in a solvent and a dyestuff or a colored pigment.

15. A process as claimed in claim 9, wherein the same toner is employed during the formation of each image.

16. A process as claimed in claim 13, wherein the copolymer includes by weight 65–80% of I, 18–30% of II, and 0.1–5% of III.

17. A process as claimed in claim 13, wherein the copolymer includes units of methyl methacrylate.

18. A process as claimed in claim 9, wherein a four-color image comprising the colors cyan, magenta, yellow, and black is produced.

* * * * *

UNITED STATES PATENT AND TRADEMARK OFFICE

CERTIFICATE OF CORRECTION

PATENT NO. : 5,700,618

DATED : December 23, 1997

INVENTOR(S) : Raimund Josef FAUST, et al.

It is certified that error appears in the above-identified patent and that said Letters Patent is hereby corrected as shown below:

Column 4, errors; line 19, delete "08/679,433" and insert --08/579,433--; line 60, delete "With" and insert --with--.

Signed and Sealed this

Twenty-third Day of June, 1998

*Attest:*

Bruce Lehman

BRUCE LEHMAN

*Attesting Officer*

*Commissioner of Patents and Trademarks*